US009030186B2

(12) United States Patent
Gupta et al.

(10) Patent No.: US 9,030,186 B2
(45) Date of Patent: May 12, 2015

(54) BANDGAP REFERENCE CIRCUIT AND REGULATOR CIRCUIT WITH COMMON AMPLIFIER

(75) Inventors: Rakesh K. Gupta, Ballia (IN); Jaideep Banerjee, Gurgaon (IN); Sanjay K. Wadhwa, Noida (IN)

(73) Assignee: Freescale Semiconductor, Inc., Austin, TX (US)

( * ) Notice: Subject to any disclaimer, the term of this patent is extended or adjusted under 35 U.S.C. 154(b) by 330 days.

(21) Appl. No.: 13/547,042

(22) Filed: Jul. 12, 2012

(65) Prior Publication Data

US 2014/0015509 A1 Jan. 16, 2014

(51) Int. Cl.
*G05F 3/22* (2006.01)
*G05F 3/30* (2006.01)

(52) U.S. Cl.
CPC ..... *G05F 3/30* (2013.01); *Y10S 323/901* (2013.01)

(58) Field of Classification Search
USPC ..... 323/312, 313, 314, 315, 316, 901; 363/49, 50
See application file for complete search history.

(56) References Cited

U.S. PATENT DOCUMENTS

| | | | | |
|---|---|---|---|---|
| 4,064,448 | A | 12/1977 | Eatock | |
| 5,581,174 | A * | 12/1996 | Fronen | 323/316 |
| 5,629,611 | A * | 5/1997 | McIntyre | 323/313 |
| 5,867,013 | A * | 2/1999 | Yu | 323/314 |
| 6,091,285 | A * | 7/2000 | Fujiwara | 327/539 |
| 6,507,180 | B2 * | 1/2003 | Eguchi | 323/314 |
| 6,630,859 | B1 * | 10/2003 | Wang | 327/539 |
| 6,815,941 | B2 * | 11/2004 | Butler | 323/313 |
| 6,933,770 | B1 * | 8/2005 | Ranucci | 327/539 |
| 6,992,472 | B2 * | 1/2006 | Schimper | 323/313 |
| 7,019,584 | B2 * | 3/2006 | Bartel et al. | 327/539 |
| 7,208,929 | B1 * | 4/2007 | Rabeyrin et al. | 323/313 |
| 7,208,930 | B1 | 4/2007 | Tran | |
| 7,233,136 | B2 * | 6/2007 | Makino et al. | 323/313 |
| 7,659,705 | B2 * | 2/2010 | Hung | 323/313 |
| 8,269,477 | B2 * | 9/2012 | Jo | 323/313 |
| 2004/0124825 | A1 * | 7/2004 | Marinca | 323/316 |
| 2006/0006927 | A1 * | 1/2006 | Nakada | 327/539 |
| 2007/0052405 | A1 * | 3/2007 | Mochizuki et al. | 323/316 |
| 2008/0309308 | A1 | 12/2008 | Howe | |

OTHER PUBLICATIONS

Khan et al., "Low Power Startup Circuits for Voltage and Current Reference with Zero Steady State Current", The International Symposium on Low Power Electronics and Design 2003 (ISLPED'03), Aug. 25-27, 2003, Seoul, Korea.

Rincon-Mora, G., Allen, P.E., "A Low-Voltage, Low Quiescent Current, Low Drop-Out Regulator", IEEE JSSC 1998, pp. 36-44.

(Continued)

*Primary Examiner* — Gary L Laxton
(74) *Attorney, Agent, or Firm* — Charles Bergere

(57) ABSTRACT

A bandgap voltage reference and voltage regulator system includes a bandgap voltage reference circuit and a voltage regulator circuit that share a single, common amplifier. The amplifier acts as a gain stage for the reference circuit and as an error amplifier for a driver stage of the regulator circuit. The regulator circuit has an input reference generated by the reference circuit, and the reference circuit acts as a load to the driver stage, obviating the need for a bias resistance network. By sharing the amplifier and obviating the need for a resistance network, the area and overall quiescent current of the system are reduced. The system can be implemented in CMOS/BiCMOS technology and is suited for low power applications.

11 Claims, 7 Drawing Sheets

(56) References Cited

OTHER PUBLICATIONS

Jia C., Qin B., Chen Z. "A Linear Voltage Regulator for PLL in SOC Application", WiCOM'06, pp. 1-4.
Antheunis R. and Loo I.V., "Simple scalable CMOS linear regulator architecture", ESSCIRC'01, pp. 365-368.
Asteriadis A., Laopoulos, T., Siskos, S, Bafleur, M., "A low quiescent-current, low supply-voltage linear regulator", IMTC'04, pp. 1536-1541.
Jhuang H. S., Wang Z. H., Zeng Z. Y., Tsai C.H., "A low dropout linear regulator with high power supply rejection", ISIC'09, pp. 41-44.

* cited by examiner

BANDGAP REFERENCE CIRCUIT AND REGULATOR CIRCUIT WITH COMMON AMPLIFIER

BACKGROUND OF THE INVENTION

The present invention relates generally to voltage reference and voltage regulator circuits, and more particularly, to a bandgap voltage reference and regulator circuit with a common amplifier.

Voltage references and voltage regulators are electronic circuits that are coextensively used in electronic circuits. Bandgap based voltage references supply a constant and stable reference voltage, typically within the bandgap voltage operating point of 1.2V, to other devices in a circuit such as voltage regulators. Voltage regulators provide a constant voltage, independent of load current, for a predetermined range of load currents.

The bandgap voltage reference typically includes a bandgap core having multiple resistors in combination with multiple transistors and a gain stage to generate the reference voltage equal to the bandgap voltage of the semiconductor material. The voltage regulator receives an input reference voltage generated by the bandgap voltage reference. The voltage regulator typically includes multiple transistors with multiple output resistors in a voltage divider arrangement as load in combination with an error amplifier to regulate and maintain the output voltage. Bandgap voltage references together with voltage regulators are able to supply a voltage that is stable and self-regulated over time under varying load currents, voltage supplies and temperatures. However, the use of these two circuits in tandem as conventionally arranged is relatively expensive to implement from power and area considerations as the industry demands integrated circuit (IC) designs with ever decreasing power supplies and smaller footprints. Each circuit occupies valuable circuit area and requires significant power in space-limited and low power applications.

Accordingly, there is a need for addressing or at least alleviating some of the above limitations and problems.

BRIEF DESCRIPTION OF THE DRAWINGS

The accompanying drawings incorporated herein and forming a part of the specification illustrate several aspects of the present invention and, together with the description, serve to explain the principles of the invention. While the invention will be described in connection with certain embodiments, there is no intent to limit the invention to those embodiments described. On the contrary, the intent is to cover all alternatives, modifications and equivalents as included within the scope of the invention as defined by the appended claims. In the drawings:

DETAILED DESCRIPTION

The present invention provides a bandgap voltage reference and voltage regulator system that includes a bandgap voltage reference circuit and a voltage regulator circuit that share a single, common amplifier. The amplifier acts as a gain stage for the bandgap voltage reference circuit and an error amplifier for a driver stage of the voltage regulator circuit. The voltage regulator circuit has an input reference generated by the bandgap voltage reference circuit. The bandgap circuit acts as a load to the driver stage of the regulator circuit, which obviates the need for a bias resistance network, which is typically needed in conventional linear regulators to support the no load condition. The system does not require a resistor network to bias the output driver transistor. Thus, without the need for a resistor network and using a shared amplifier, the area and overall quiescent current are less than those of conventional circuits.

In one embodiment, the present invention provides an operational amplifier shared by a bandgap voltage reference circuit and a voltage regulator circuit having a driver stage. The operational amplifier includes an inverted input, a non-inverted input, an output, a first stage, and a second stage. The first stage is connected to the inverted and non-inverted inputs, and the second stage generates the output. A current reference stage includes elements from the first stage of the operational amplifier. The operational amplifier provides a gain stage for the bandgap voltage reference circuit, and provides an error amplifier for the driver stage of the voltage regulator circuit.

Figure 1:
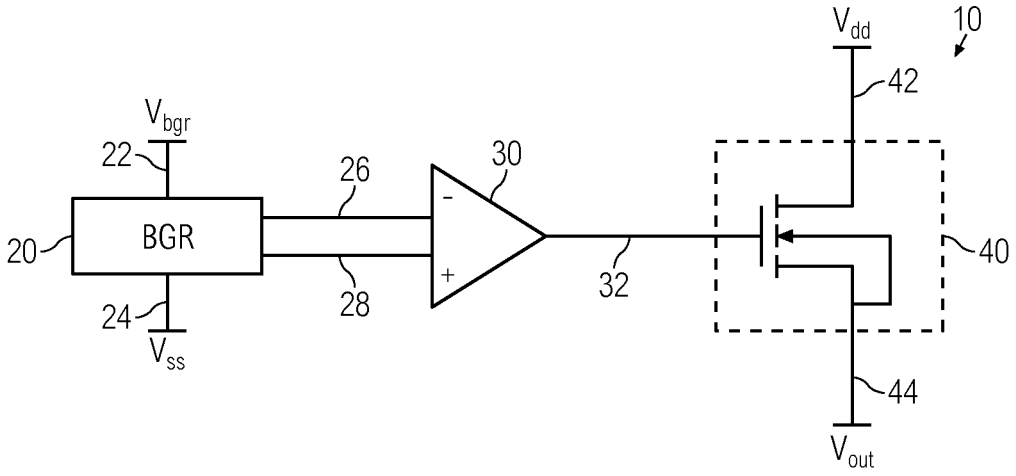
FIG. 1 is a block diagram of a bandgap voltage reference and voltage regulator in accordance with an embodiment of the invention.

Referring now to FIG. 1, a bandgap voltage reference and voltage regulator system circuit 10 is shown in accordance with an embodiment of the invention. The system 10 includes a bandgap voltage reference circuit 20 that is connected between an operating voltage (Vbgr) 22 and a common ground (Vss) 24 or the like. The bandgap voltage reference circuit 20 provides an inverted input 26 and a non-inverted input 28 to an error amplifier or operational amplifier (op amp) 30. The op amp 30 generates a voltage (Vdriver) 32, which is provided to a driver stage 40 of a voltage regulator.

In one embodiment, the driver stage 40 comprises a voltage driver transistor, such as metal oxide semiconductor field effect transistor (MOSFET), where the output of the op amp 30 is connected to the gate of the voltage driver transistor, a drain of the transistor is connected to the supply voltage (Vdd) 42, and the output voltage (Vout) 44 of the system 10 is derived at the source of voltage driver transistor. The output voltage Vout 44 is the main output of the system 10. Although the voltage driver transistor is shown as a NMOS transistor, it will be appreciated that the transistor can take other forms.

For example, the transistor may be a PMOS transistor to form a PMOS driver to achieve a low dropout regulator (LDO). In such an LDO, the source of the PMOS transistor is connected to the supply voltage (Vdd), the drain is connected to the Vout 44, and the output of the operational amplifier 30 drives the gate of the PMOS transistor. Also, for a PMOS driver, the connections at the inputs of the op amp 30 are reversed.

Figure 2:
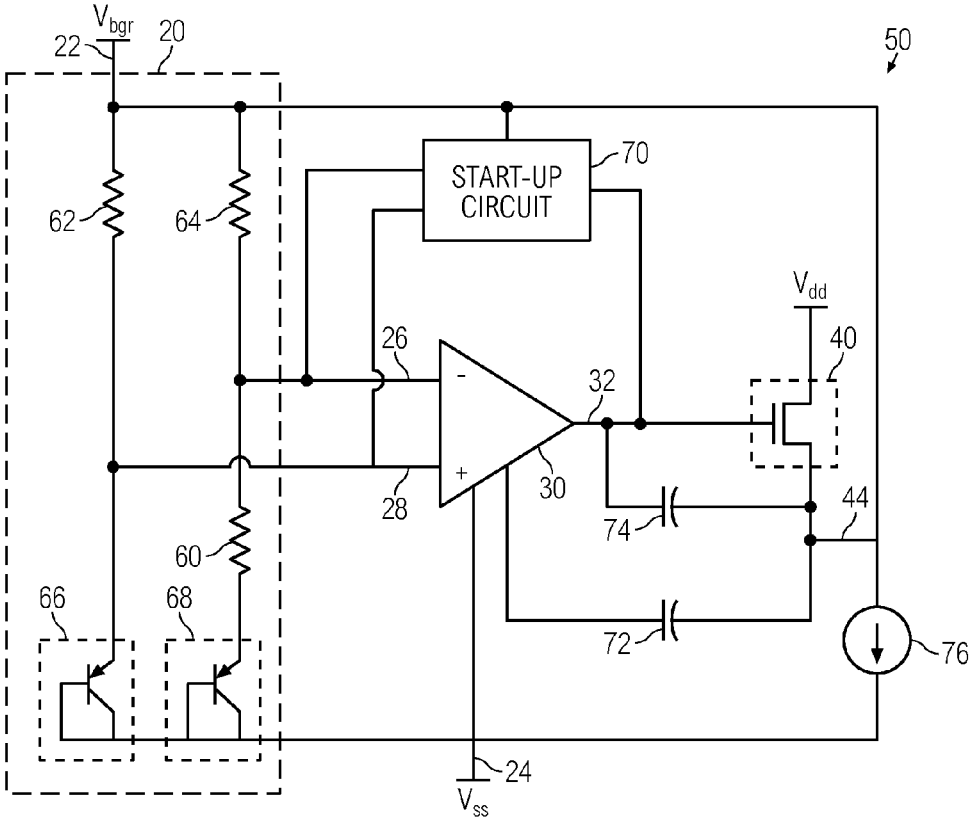
FIG. 2 is a block diagram of the bandgap voltage reference and voltage regulator of FIG. 1 in greater detail in accordance with an embodiment of the invention.

Referring to FIG. 2, a bandgap voltage reference and voltage regulator system 50 in accordance with an embodiment of the invention is shown. The system 50 includes the bandgap voltage reference circuit 20, the op amp 30 and the driver stage 40 discussed above with reference to FIG. 1. As will be discussed in more detail with reference to FIG. 3, in one embodiment the op amp 30 is a two stage operational amplifier with self-bias current. The bandgap voltage reference circuit 20 includes first, second and third core resistors 60, 62, and 64, first core transistor 66, and second core transistor 68.

The first and second core transistors 66, 68 are connected together, each having its base and collector connected to the common ground (Vss). A ratio "M" between the emitter areas of the first and second core transistors 66, 68 may be substantially matched. In one embodiment, the area of the second core transistor 68 has an area that is M times larger than the area of the first core transistor 66.

A first end of the first core resistor 60 is connected to the emitter of the second core transistor 68, and a first end of the second core resistor 62 is connected to the emitter of the first core transistor 66. A first end of the third core resistor 64 is connected to a second end of the first core resistor 60 such that the first and third core resistors 60, 64 are connected in series. A second end of the second core resistor 62 and a second end of the third core resistor 64 are connected together and to the operating voltage (Vbgr) 22.

The inverted input 26 of the op amp 30 is connected to a node between the first and third core resistors 60, 64, and the non-inverted input 28 of the op amp 30 is connected to a node between the second core resistor 62 and the emitter of the first core transistor 66. In this embodiment, the first core transistor 66 and the second core transistor 68 are parasitic bipolar transistors. The output of the op amp 30 is connected to the driver stage 40.

A start-up circuit 70, in accordance with an embodiment of the invention, is connected to the inverted input 26 and non-inverted input 28 of the op amp 30. The start-up circuit 70 also is connected to the operating voltage (Vbgr) 22 and the second ends of the second and third core resistors 62, 64. The start-up circuit 70 further is connected to the output of the op amp 30, i.e. the voltage (Vdriver) 32 at a node between the output of the op amp 30 and an input of the driver stage 40. In this embodiment, the driver stage 40 comprises a transistor having a gate connected to the output of the op amp 30, and a drain connected to the supply voltage $V_{dd}$.

The system 50 also has a first capacitor 72 connected between an input of a second stage (Diff_out) of the op amp 30 and a source of the transistor of the driver stage 40. A second capacitor 74 is connected to the output of the op amp 30 and the source of the transistor of the driver stage 40. Also, the output voltage (Vout) 44 of the system 50 is provided at the source of the transistor of the driver stage 40. The first and second capacitors 72, 74 provide stability to the system 50 as well as ensure high unity-gain bandwidth. The first capacitor 72 introduces a local, small-signal feedback from the output voltage (Vout) 44 to the input of second stage (Diff_out) of the op amp 30, and significantly increases the unity-gain bandwidth (UGB) of the system 50, which in turn improves the transient behaviour of the system with respect to load current regulation. In one embodiment, the first capacitor 72 has a relatively higher capacitance value than the second capacitor 74. The first and second capacitors 72, 74 may comprise MOS capacitances that have a certain variation in capacitances across process-voltage-temperature (PVT) variations. The second capacitor 74 is placed to maintain a minimum phase-margin of 45° across PVT variations.

A switching load current 76 for the external circuitry that the system 50 is supplying is connected to the source of the transistor of the voltage driver 40. More particularly, the switching load current 76 is connected between the operating voltage Vbgr and the common ground Vss, and the connection between the operating voltage Vbgr and the load current 76 also is connected to the start-up circuit 70 and the source of the transistor of the driver stage 40 (i.e., the voltage Vout). It will be appreciated that any number of circuits could be supplied, such as for example a real time clock (RTC) module until the current supply capability limit of the system 50 is reached. It will be appreciated that the driver stage 50 can be made using a PMOS transistor.

The start-up circuit 70 operates during the supply ramp up and sets the bias currents in the op amp 30. The start-up circuit 70 pushes the system 50 towards a desirable operating point (Vbgr≈1.22V). Once the system 50 has started working such that regulation has started, the start-up circuit 70 automatically shuts off by detecting the level of the regulator output voltage (Vout). Compensation also has been implemented in order to achieve stability as well as to obtain a higher UGB. As a result of this design, the system 50 is able to provide fast transient response during load regulation.

Figure 3:
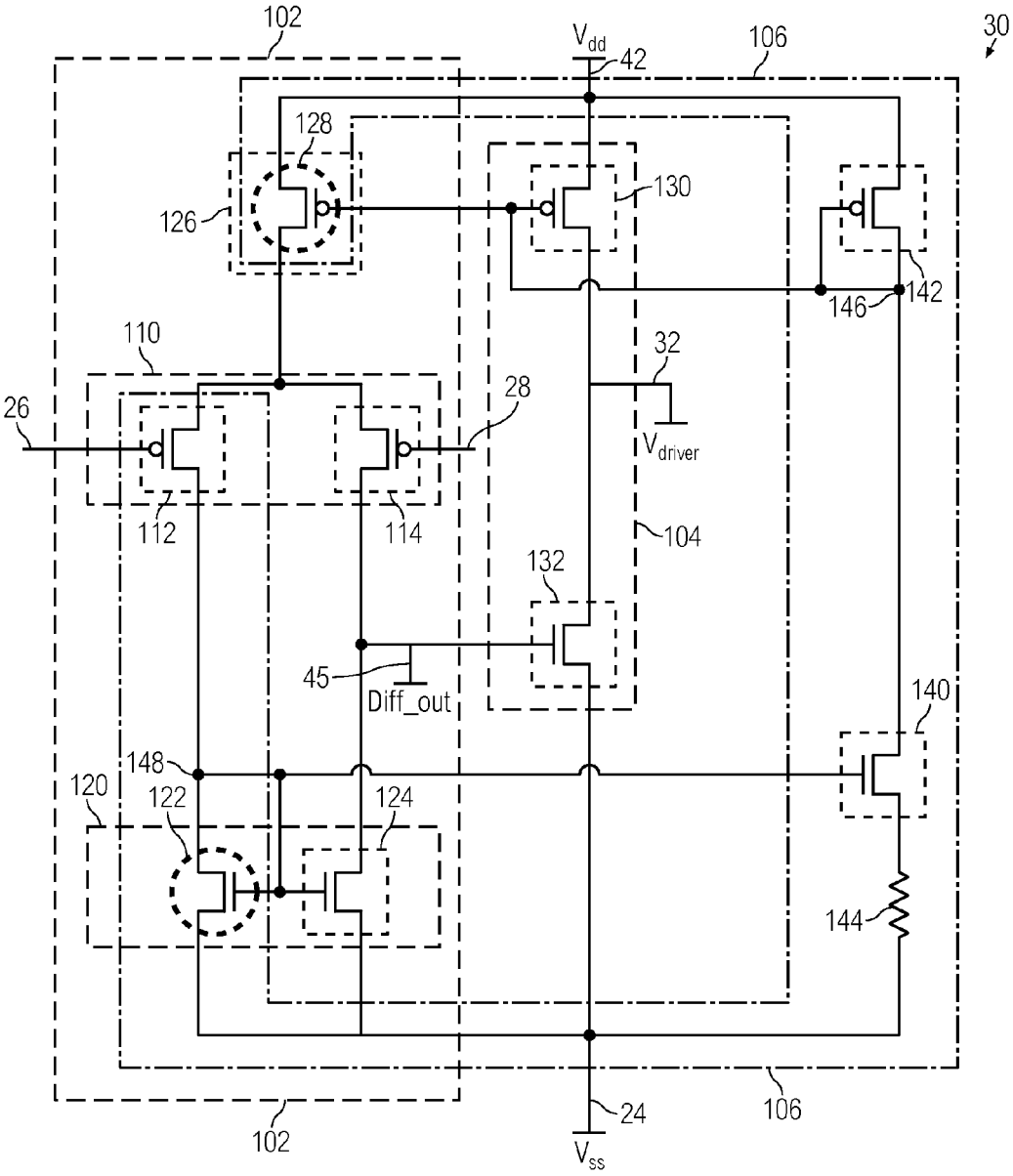
FIG. 3 is a schematic circuit diagram of the operational amplifier 30 of FIGS. 1 and 2 shown in greater detail in accordance with an embodiment of the invention.

Referring to FIG. 3, a schematic circuit diagram of an embodiment of the op amp 30 is shown. The op amp 30 comprises a first stage 102, a second stage 104, and a current reference stage 106. In the embodiment shown, the op amp 30 is a self-biased two stage operational amplifier.

The first stage 102 comprises an input differential section 110, shown in this embodiment as an input differential pair. The input differential section 110 comprises a first input differential section transistor 112 and a second input differential section transistor 114. The first and second input differential section transistors 112, 114 in this embodiment are both PMOS transistors with their sources connected together. The gate of the first input differential section transistor 112 comprises the inverted input 26 of the op amp 30 and the gate of the second input differential section transistor 114 comprises the non-inverted input 28 of the op amp 30.

The first stage 102 also comprises a load section 120, shown in this embodiment as a load pair including first and second load section transistors 122, 123. The first and second load section transistors 122, 124 in this embodiment are both NMOS transistors with the sources connected together and to common ground (Vss). The gate and drain of the first load section transistor 122 are connected to the drain of the first input differential section transistor 112, and the gate of the first load section transistor 122 is connected to the gate of the second load section transistor 124. The drain of the second load section transistor 124 is connected to the drain of the second input differential section transistor 114.

The first stage 102 also has a tail current source section 126, shown in this embodiment as a tail current source transistor 128 for the input differential pair of the input differential section 110. The tail current source transistor 128 in this embodiment is a PMOS transistor having a drain connected to the sources of the first and second input differential section transistors 112, 114 of the input differential pair. The source of the tail current source transistor 128 is connected to the supply voltage (Vdd) 42.

The second stage 104 of the op amp 30 comprises a first second-stage transistor 130 and a second second-stage transistor 132. The first second-stage transistor 130 in this embodiment is a PMOS transistor, and the second second-stage transistor 132 in this embodiment is a NMOS transistor. The drains of the first and second second-stage transistors 130, 132 are connected together. The source of the first second-stage transistor 130 is connected to the supply voltage (Vdd) 42, and the source of the second second-stage transistor 132 is connected to the common ground (Vss) 24. The output voltage (Vdriver) 32 is derived at a node between the drains of the first and second second-stage transistors 130, 132. The gate of the first second-stage transistor 130 is connected to the gate of the tail current source transistor 128. The gate of the second second-stage transistor 132 is connected to the drain of the second input differential section transistor 114 of the input differential pair and the drain of the second load section transistor 124 of the load section 120.

The current reference stage 106 of the op amp 30 comprises the first input differential section transistor 112 of the input differential section 110, the first load section transistor 122 of the load section 120, the tail current source transistor 128 of the tail current source section 126, a first current reference stage transistor 140, a second current reference stage transistor 142, and a current reference stage resistor 144. In the embodiment shown, the first current reference stage transistor 140 is a NMOS transistor and the second current reference stage transistor 142 is a PMOS transistor. The drain of the first current reference stage transistor 140 is connected to the drain and gate of the second current reference stage transistor 142; the gate of the first current reference stage transistor 140 is connected to the drain and gate of the first load section transistor 122 and the drain of the first input differential section transistor 112; and the source of the first current reference stage transistor 140 is connected to one end of the current reference stage resistor 144, with the other end of the current reference stage resistor 144 connected to the common ground (Vss) 24. The drain and gate of the second current reference stage transistor 142, in addition to being connected to the drain of the first current reference stage transistor 140, are connected to the gate of the first second-stage transistor 130 and the gate of the tail current source transistor 128. The source of the second current reference stage transistor 142 is connected to the supply voltage (Vdd) 42.

The op amp 30 is a two stage operational amplifier in which self-current biasing is implemented to save bias-current. The self-bias operational amplifier is arranged with the current reference structure with stabilization of transconductance (Gm) or constant Gm for all transistors. It will be appreciated that the elements of the first stage 102 are shared with the current reference stage 106 to save bias current. In this embodiment shown, the first load section transistor 122 and the tail current source transistor 128 are used in both the first stage 102 and the current reference stage 106. Such a configuration contributes to limit bias current. The tail current source transistor 128, the first load section transistor 122, the first current reference stage transistor 140, the second current reference stage transistor 142, and the current reference stage resistor 144 form a ΔVgs/R current reference circuit. The current flowing through the tail current source transistor 128 is I=ΔVgs/R, where ΔVgs is the voltage difference across current reference stage resistor 144. A ΔVgs voltage difference is created across the current reference stage resistor 144 because the size of the first current reference stage transistor 140 is "n" times the size of the first load section transistor 122. Self-biasing eliminates the need of a separate current reference circuit to bias the amplifier or very large area resistance used in place of the tail current source transistor 128.

Figure 4:
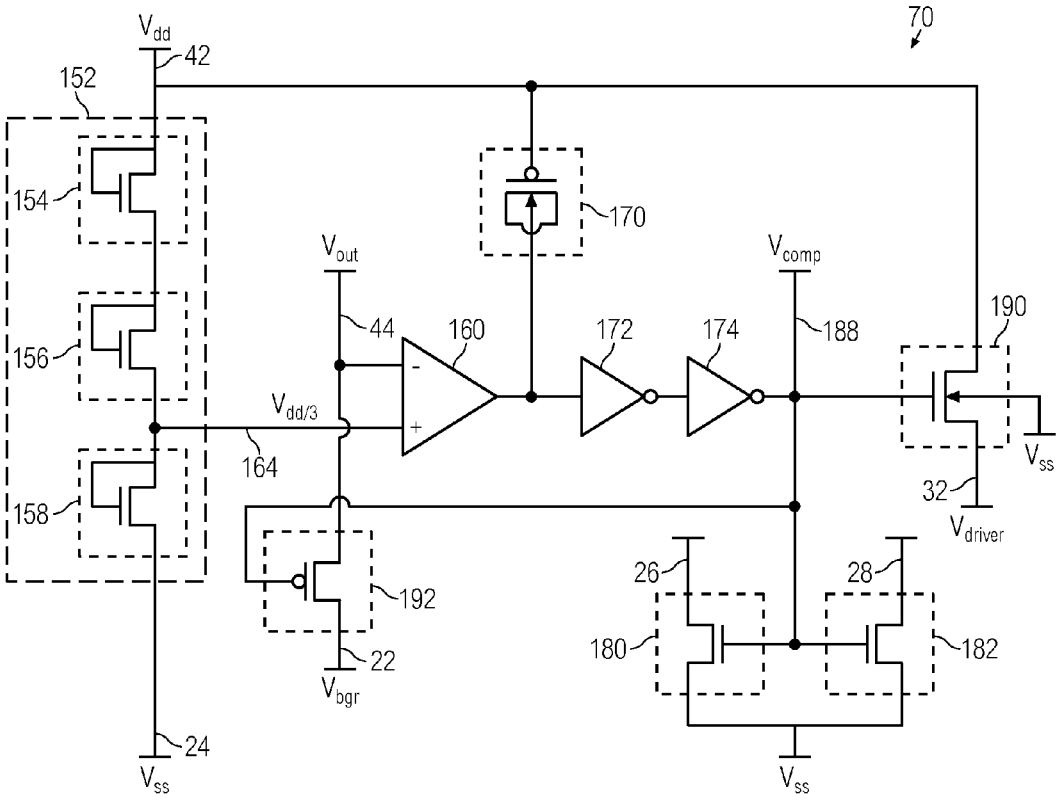
FIG. 4 is a schematic circuit diagram of the start-up circuit of FIG. 2 shown in greater detail in accordance with an embodiment of the invention.

Referring to FIG. 4, a schematic circuit diagram of the start-up circuit 70 of FIG. 2 in accordance with an embodiment of the invention is shown. The start-up circuit 70 aids in bringing the operating voltage (Vbgr) of the bandgap voltage reference to a desired voltage of 1.2V with the supply voltage (Vdd) ramp-up. It will be appreciated that bandgap circuits typically require start-up circuits because of the feedback mechanisms used. In implementing the bandgap voltage reference and voltage regulator system 10 or 50, start-up requirements and considerations include having the start-up with supply ramp-up without relying on any enable/disable signal; the offset voltage of the op amp 30; and of the loading provided by the bandgap circuit.

FIG. 4 shows the start-up circuit 70 with a voltage divider 152 having three voltage divider or diode connected transistors 154, 156, 158. Each of the transistors 154, 156, 158 has a bulk or body connected to the source, and the drain and gate connected together. The first diode connected transistor 154 has a source connected to the drain of the second diode connected transistor 156, the source of the second diode connected transistor 156 is connected to the drain of the third diode connected transistor 158, and the source of the third diode connected transistor 158 is connected to the common ground (Vss) 24. The drain of first diode connected transistor 154 is connected to the supply voltage (Vdd) 42. It will be appreciated that the voltage divider 152 shown in FIG. 4 is shown with NMOS transistors, however, the voltage divider 152 can be implemented using PMOS transistors, poly resistors, or the like.

A comparator 160 has a non-inverted input connected to a node between the source of the second diode connected transistor 156 and the drain of the third diode connected transistor 158, and a voltage (Vdd/3) 164 is provided to the non-inverting input of the comparator 160. An inverting input of the comparator 160 receives the output voltage (Vout) 44. A capacitor 170 is connected between an output of the comparator 160 and the supply voltage Vdd 42. In one embodiment, the capacitor 170 is a PMOS capacitor. The capacitor 170 pulls up the output of the comparator 160 when the supply voltage (Vdd) 42 ramps up during start-up. The output of the comparator 160 also is connected to an input of a first inverter 172, and the output of the first inverter 172 is connected to an input of a second inverter 174. The output of the second inverter 174 is connected to a gate of a first start-up circuit transistor 190.

The output of the second inverter 174 also is connected to gates of second and third start-up circuit transistors 180, 182. The gates of the second and third start-up circuit transistors 180, 182 are connected together and sources of the second and third start-up circuit transistors 180, 182 are connected to the common ground (Vss). Each of the transistors 180, 182 also has a bulk or body connected to its source. The drain of the second start-up transistor 180 is connected to the inverted input 26 of the op amp 30 (see FIG. 2), and the drain of the third start-up transistor 182 is connected to the non-inverted input 28 of the op amp 30. A comparator voltage (Vcomp) 188 is provided to the gates of the second and third start-up circuit transistors 180, 182 by way of the output of the second inverter 174.

As mentioned above, the first start-up circuit transistor 190 has a gate connected to the output of the second inverter 174; further, the supply voltage (Vdd) 42 is provided to the drain of first start-up circuit transistor 190, the driver voltage (Vdriver) 32 is provided to the source, and the bulk or body of the first start-up circuit transistor 190 is connected to the common ground (Vss).

A fourth start-up circuit transistor 192 has a gate connected to the output of the second inverter 174 and receives the comparator voltage (Vcomp) 188, a source connected to the inverted input of the comparator 160 and the output voltage (Vout) 44, and a drain that receives the operating voltage (Vbgr) 22.

As will be apparent to those of skill in the art, the transistors may take different forms than shown. For example, the transistors 154, 156, 158, 180, 182, 190 are enhancement mode NMOS transistors, and transistor 192 is an enhancement mode PMOS transistor, but these transistors could be formed as PMOS and NMOS respectively. In this embodiment, the voltage divider 152 comprises transistors instead of poly resistors to allow for a low area implementation.

It will be appreciated that except for the comparator voltage (Vcomp) 188, all other voltages (Vout 44, Vdriver 32, operational amplifier inverted input 26, operational amplifier non-inverted input 28, and Vbgr 22) are present in the system 10 shown in FIG. 1. A function of the start-up circuit 70 is to control voltages (Vout 44, Vdriver 32, inverted input 26, non-inverted 28, Vbgr 22) using the comparator voltage (Vcomp) 188 during the power up phase. During power up, initially Vdd 42 and Vout 44=0, and thus the output of the comparator 160 is zero, and hence Vcomp 188=0. As the supply voltage Vdd 42 ramps up, (Vdd/3) 164 ramps up, and hence Vcomp 188 ramps up, turning the first, second and third start-up circuit transistors 190, 180, 182 ON. When Vcomp 188 crosses a threshold voltage (Vth) of the first start-up circuit transistor 190, Vdriver 32 ramps up and starts the bandgap functioning. As the driver voltage (Vdriver) 32 goes beyond the threshold voltage of the transistor of the driver stage 40, the driver transistor turns ON and starts pulling up Vout 44. Once Vout 44 has reached a voltage greater than the predetermined level (Vdd/3) 164, the comparator 160 output toggles to zero, and hence Vcomp also toggles to zero. Until Vcomp toggles to zero, the inverted input 26=the non-inverted input 28=0, so the first start-up circuit transistor 190 is ON, the fourth start-up circuit transistor 192 is OFF (Vout is not connected to Vbgr 22). When Vcomp 188 toggles to zero, then the inverted and non-inverted inputs 26, 28 are released, the first start-up circuit transistor 190 goes OFF, and the fourth start-up circuit transistor 192 goes ON (Vout 44 is connected to Vbgr 22).

In one embodiment, during start-up, the inverted and non-inverted inputs 26, 28 are pulled towards the common ground (Vss) so that the self-biased current reference 76 can start. Accordingly, the fourth start-up circuit transistor 192 cuts the feedback path from Vout 44 to the operating voltage of the bandgap voltage reference (Vbgr) 22 such that during start-up, the bandgap circuit 20 does not draw any current and the output voltage Vout 44 can rise towards the desired voltage level.

Figure 5:
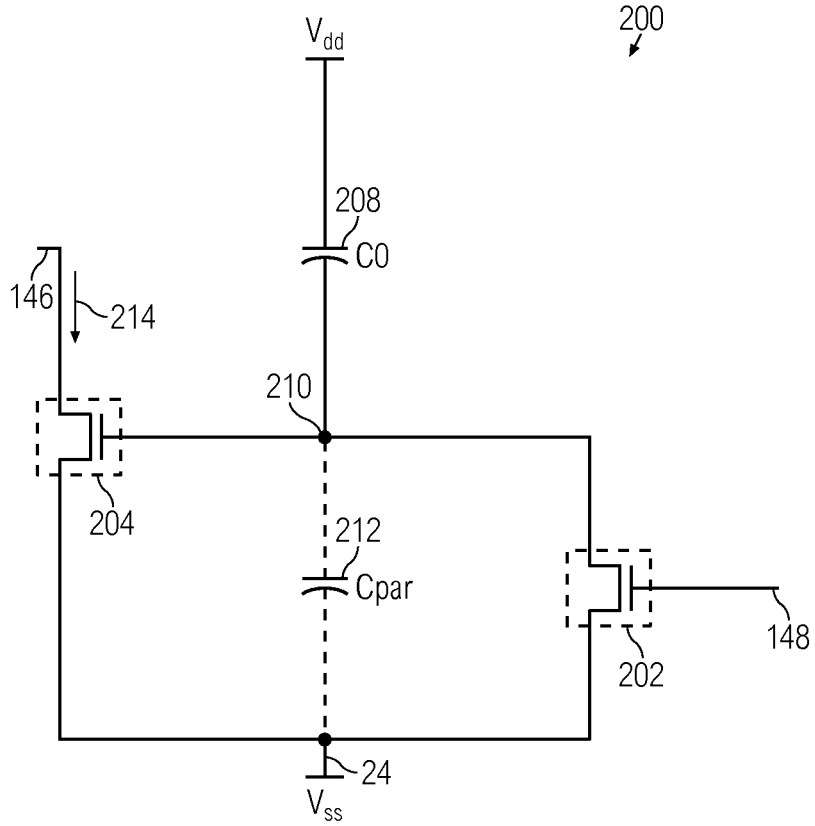
FIG. 5 is a schematic circuit diagram of another start-up circuit for the current reference stage of FIG. 3 in accordance with an embodiment of the invention.

Referring to FIG. 5, in one embodiment, a second start-up circuit 200 pulls down the gate of the second current reference stage transistor 142 of the current reference stage 106 towards the common ground (Vss) to start the current reference stage 106. The second start-up circuit 200 comprises a first second-start-up-circuit transistor 202, a second second-start-up-circuit transistor 204, and a first second-start-up-circuit capacitor 208. The first and second second-start-up-circuit transistors 202, 204 are NMOS transistors in this embodiment and their sources are connected to the common ground (Vss). The first second-start-up-circuit capacitor 208 has one side that receives the supply voltage Vdd and the second side is connected to the drain of the first second-start-up-circuit transistor 202 and the gate of the second second-start-up-circuit transistor 204. The gate of the first second-start-up-circuit transistor 202 is arranged to be connected to a node 148, shown in FIG. 3, between the drains of the first input differential section transistor 112 and the second load section transistor 122. The drain of the second second-start-up-circuit transistor 204 is arranged to be connected to a node 146 (FIG. 3) between the drains of the first and second current reference stage transistors 140, 142.

In operation, at start up, the supply voltage (Vdd) ramps up from 0V, node 210 (FIG. 5) follows the supply voltage (Vdd) to maintain zero potential across the first second-start-up-circuit capacitor (C0) 208. A second-start-up-circuit parasitic capacitance (Cpar) 212 is generated between node 210 and the common ground (Vss), which forms a voltage divider with the first second-start-up-circuit capacitor 208. The voltage at node 210 may be written as VCTRL=Vdd×C0/(C0+Cpar). The parasitic capacitance (Cpar) 212 is typically very low, while C0 can be taken in the range of 0.5 pf-1.0 pf, then VCTRL≈supply voltage (Vdd). Hence, the second second-start-up-circuit transistor 204 will go ON as the supply voltage (Vdd) rises, which generates a start-up current Istart 214, shown by arrow, in the second second-start-up-circuit transistor 204 that will start discharging node 146 of FIG. 3 towards the common ground (Vss) and the current reference stage 106 (FIG. 3) starts. As the current starts flowing in the current reference stage 106, node 148 starts charging from the common ground (Vss) towards the supply voltage (Vdd) and as it crosses Vt of the first second-start-up-circuit transistor 202, the first second-start-up-circuit transistor 202 turns ON and the CTRL node 210 (FIG. 5) is pulled down to the common ground (Vss), which turns OFF the second second-start-up-circuit transistor 204. Thus, the second start-up circuit 200 disconnects from the reference current stage 106, i.e. the bandgap voltage reference and voltage regulator system 50, and no current flows through the second start-up circuit 200.

Figure 6:
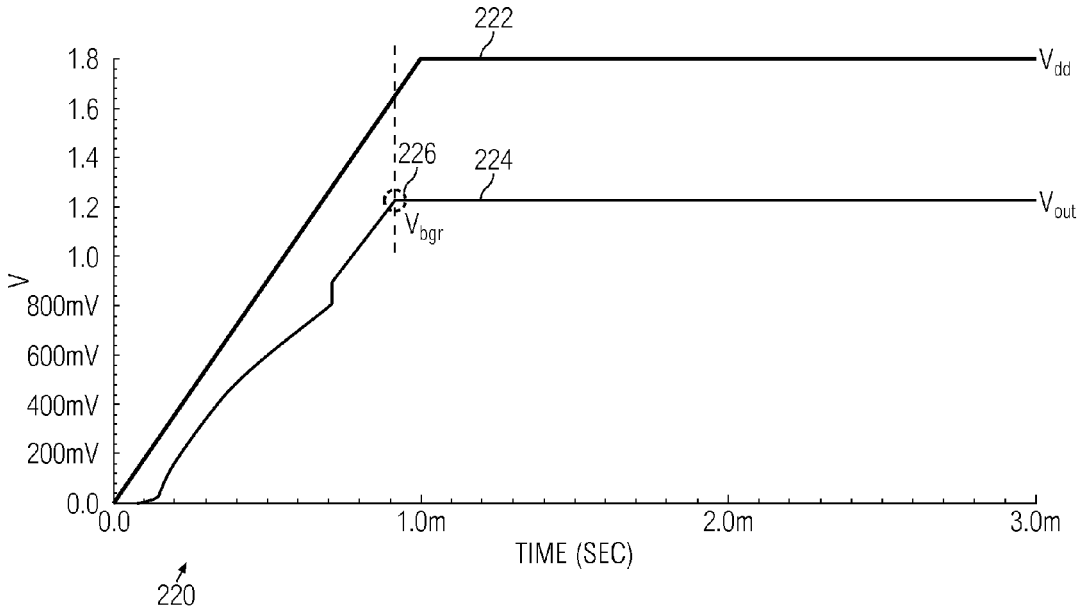
FIG. 6 is a graph showing the voltage response over time of the bandgap voltage reference and voltage regulator of FIGS. 1-4 in accordance with an embodiment of the invention.

One embodiment of the bandgap voltage reference and voltage regulator system 50 has been simulated with Vdd variations and load current variations from 2.7V to 3.6V, and from 10 μA to 1 mA, respectively. The target Vbgr value is 1.22V across a temperature range of −40° C. to 125° C. The simulated quiescent current consumption is 10.5 μA at 3.3V. FIG. 6 is a graph 220 of the voltage response over time of Vdd 222 and Vout 224 of the system 50. As shown in FIG. 6, Vbgr settles at 1.22V when Vdd crosses≈1.7V.

In the simulation Vbgr was typically 1.222V with a minimum of 1.204V and a maximum of 1.236V. The quiescent current was typically 10.92 μA with a minimum of 10.65 μA and a maximum 13.17 μA. The phase margin in the simulation was a minimum of 40 degrees. The unity gain bandwidth (UGB) at no load current was 5 MHz and at max load current of 1 mA was 66 MHz. The graph 220 shows settling behaviour of the bandgap voltage reference and voltage regulator system 50 with supply ramp up. The dashed circle 226 identifies a portion of the Vout curve 224 shown in more detail in FIG. 7.

Figure 7:
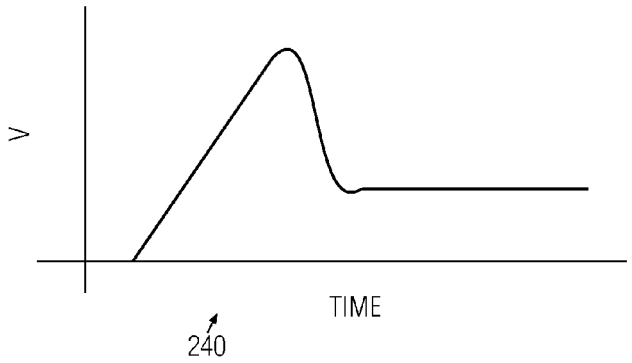
FIG. 7 is a section of the graph of FIG. 6 shown in more detail.

Referring to FIG. 7, a curve portion 240 within the dashed circle portion 226 of Vout curve 224 of FIG. 6 is shown in more detail. The response of Vout indicates a good phase margin. The graphs of FIG. 6 and FIG. 7 show that the Vbgr settles at 1.22V when Vdd crosses≈1.7V.

Figure 8:
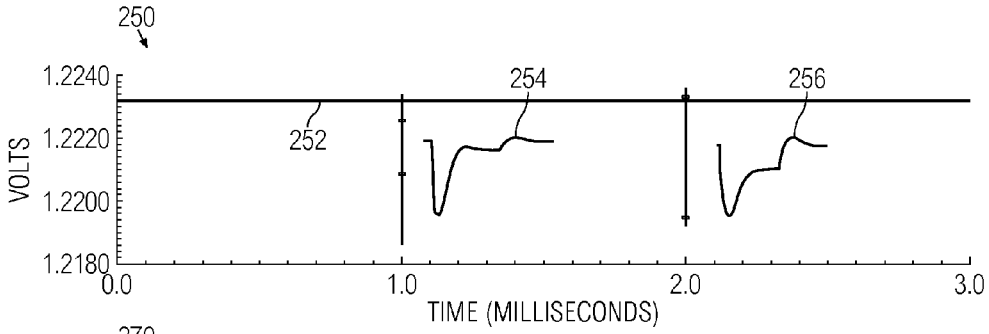
FIG. 8 is a graph showing the transient response in volts of a load regulation transient simulation result of a system in accordance with an embodiment of the invention.
Figure 9:
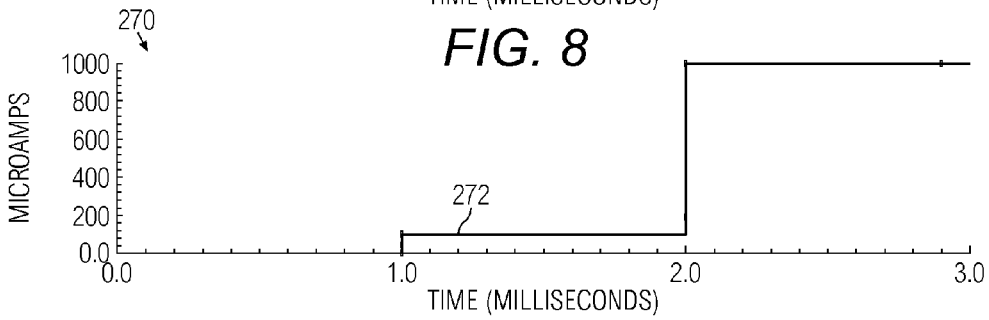
FIG. 9 is a graph showing the transient response in amps of the load regulation transient simulation result shown in FIG. 8 in accordance with an embodiment of the invention.

FIGS. 8 and 9 are graphs 250, 270 of the transient response in volts (V) 252, 254, 256, FIG. 8, and in microamps (μA) 272, FIG. 9, of a load regulation transient simulation result of the system in accordance with an embodiment of the invention. Until one (1) millisecond (ms), the load current is 0 A. At 1 ms, the load current is abruptly increased to 100 microamps (μA). At 2 ms, the load current is abruptly increased to 1 milliamp (mA). The maximum drop in output voltage Vout (44) is less than 10 millivolt (mV). Curves 254 and 256 show the settling behaviour of the system in greater detail at 1 ms and 2 ms, respectively. The curves 254, 256 show that the system has very good settling behaviour.

Figure 10:
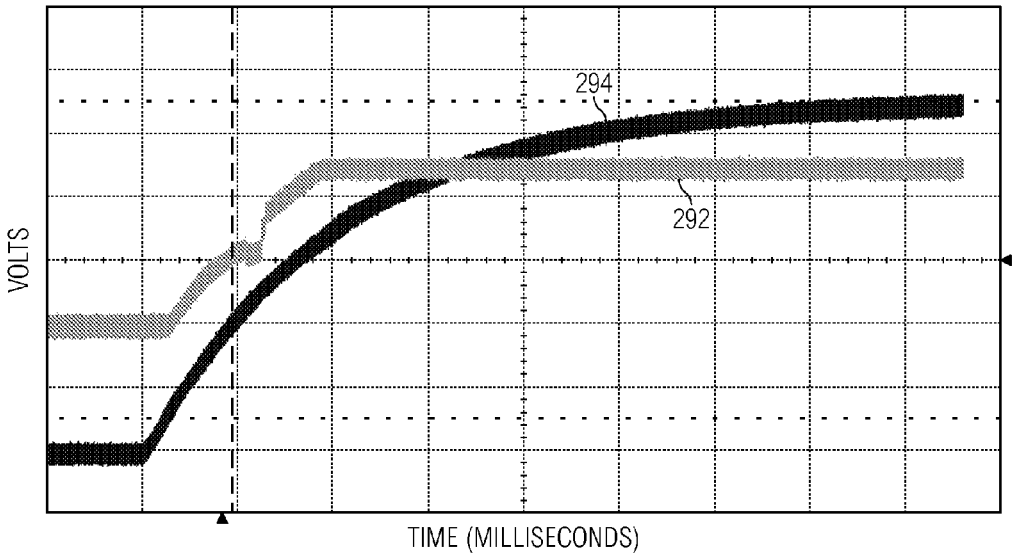
FIG. 10 is a graph showing the Vbgr settling response of a system in accordance with an embodiment of the invention.

FIG. 10 is a graph 290 showing the output voltage Vout (44) settling response of the bandgap voltage reference and voltage regulator system in silicon validation in accordance with an embodiment of the invention. The curve 292 is bandgap voltage reference (Vbgr) and the curve 294 is the supply voltage (Vdd).

As industry demands ever decreasing system power supplies and space limited footprints and the demand for scaling down of integrated circuits is being realized, efficient circuit designs conserving die space and power consumption are sought. The bandgap voltage reference and voltage regulator system described above comprises a bandgap voltage reference circuit and a voltage regulator circuit that share a single, common amplifier. The bandgap voltage reference and voltage regulator system is a self-starting bandgap-cum-regulator circuit having a single amplifier for the gain stage of the bandgap reference and an error amplifier for the driver stage of the voltage regulator. It will be appreciated that the system may comprise a linear or switching regulator, however, a linear regulator is frequently chosen for low current consumption and due to its simplicity. By sharing the amplifier, the overall area and overall quiescent current of the circuit is reduced. By reducing the overall quiescent current consumption and circuit foot print, overall die-size may be reduced and circuit efficiency improved. For example, in embodiments the quiescent current is in the range of 10 μA. As no resister network is used to bias the driver transistor stage, no bias current is required to flow through such a resistor divider or network. Thus, less die space is required. The system and circuits disclosed regulate from no load to full load conditions, with a maximum of 1 mA current capability. Accordingly, the circuit is suited for low power applications, and is particularly useful in supplying modules, such as a real time clock (RTC) and the like, which have low power budgets because these modules are generally run on a coin cell, super capacitor, or the like.

As a common amplifier is shared between the bandgap voltage reference and the voltage regulator the overall offset voltage is low and limited to the common amplifier. Offset voltage is generated, for example due to input pair mismatch of the amplifier and is limited in the circuit disclosed to the input pair of the amplifier rather than the offset of the input pair in a gain-stage of a separate bandgap voltage reference and the offset of the input pair in an error amplifier for the driver stage of the voltage regulator of a separate voltage regulator. Simulation and silicon results show that the bandgap voltage reference and voltage regulator system and circuit in accordance with an embodiment of the invention has less than ~2% variation across process, temperature, and supply voltage variation.

It will be appreciated that the circuit can be implemented in any number of ways including industry standard digital complementary metal-oxide semiconductor (CMOS) and/or BiCMOS technology.

Embodiments of the invention have been described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by the applicable law. Moreover, any combination of the above-described elements in all possible variations thereof is encompassed by the invention unless otherwise indicated herein or otherwise clearly contradicted by context.

The invention claimed is:

1. A bandgap voltage reference and voltage regulator system, comprising:

a bandgap voltage reference circuit;

a voltage regulator circuit having a driver stage;

an operational amplifier having an inverted input and a non-inverted input, wherein the operation amplifier is connected between the bandgap voltage reference circuit and the voltage regulator circuit, wherein the operational amplifier is shared by the bandgap voltage reference circuit and the voltage regulator circuit, and wherein the operational amplifier operates as a gain stage for the bandgap voltage reference circuit, and as an error amplifier for the driver stage of the voltage regulator circuit; and a start-up circuit directly connected to the inverted and non-inverted inputs of the operational amplifier, and to the output of the operational amplifier for detecting a regulator output voltage level and bringing up the system to a predetermined operating point, wherein the operational amplifier comprises:

a first stage including the inverted and non-inverted inputs of the operational amplifier;

a second stage connected to the first stage, for providing a drive voltage (Vdriver) at the output of the operational amplifier; and a current reference stage connected to the second stage and comprising elements from the first stage of the operational amplifier, wherein the first stage of the operational amplifier comprises:

an input differential section including first and second input differential section transistors;

a load section including first and second load section transistors; and a tail current source section including a tail current source section transistor, wherein:

the first input differential section transistor has a source connected to a source of the second input differential section transistor and to a drain of the tail current source section transistor, a gate connected to the inverted input of the operational amplifier, and a drain connected to a drain of the first load section transistor, the second input differential section transistor has a gate connected to the non-inverted input of the operational amplifier, and a drain connected to a drain of the second load section transistor, the first load section transistor has a gate connected to its drain and to a gate of the second load section transistor, and a source connected to a source of the second load section transistor and to a common ground (Vss), the tail current source section transistor has a gate connected to the second stage and a source connected to a supply voltage (Vdd), and wherein an output of the first stage is generated at a node between the drains of the second input differential section transistor and the second load section transistor.

2. The system of claim 1, wherein the bandgap voltage reference circuit comprises:

a first core transistor;

a second core transistor having a base and a collector connected together to a common ground (Vss) and to a base and a collector of the first core transistor;

a first core resistor having a first end connected to an emitter of the second core transistor;

a second core resistor having a first end connected to an emitter of the first core transistor, and a second end connected to an operating voltage (Vbgr); and a third core resistor having a first end connected to a second end of the first core resistor and a second end connected to the operating voltage (Vbgr), wherein the inverted input of the operational amplifier is connected to a node between the first and third core resistors and the non-inverted input of the operational amplifier is connected to a node between the second core resistor and the emitter of the first core transistor.

3. The system of claim 2, wherein the first and second core transistors are parasitic bi-polar transistors.

4. The system of claim 3, wherein an emitter area of the second core transistor is larger than an emitter area of the first core transistor.

5. The system of claim 2, wherein the driver stage of the voltage regulator circuit comprises:

a driver stage transistor having a drain connected to a supply voltage (Vdd), a gate connected to an output of the operational amplifier, and a source connected to the output of the operational amplifier and to a node between the operating voltage (Vbgr) and the second ends of the second and third core resistors, wherein the drive voltage (Vdriver) is provided at the output of the operational amplifier, and the regulator output voltage (Vout) is provided at the source of the driver stage transistor.

6. The system of claim 1, wherein the second stage of the operational amplifier comprises:

a first second-stage transistor having a source connected to the supply voltage (Vdd), and a gate connected to the gate of the tail current source section transistor; and a second second-stage transistor having a source connected to the common ground (Vss), a drain connected to a drain of the first second-stage transistor, wherein the operational amplifier output voltage (Vdriver) is generated at a node between the drains of the first and second second-stage transistors, and a gate connected to a node between the drains of the second input differential section transistor and the second load section transistor of the first stage.

7. The system of claim 6, wherein the current reference stage of the operational amplifier comprises:

the first input differential section transistor, the first load section transistor, and the tail current source section transistor of the first stage;

a first current reference stage transistor having a source connected by way of a resistor to the common ground (Vss), and a gate connected to the gates of the first and second load section transistors and the drain of the first load section transistor; and a second current reference stage transistor having a source connected to the supply voltage (Vdd), a drain connected to the drain of the first current reference stage transistor, and a gate connected to its drain and to the gates of the tail current source section transistor and the first second stage transistor.

8. The system of claim 1, wherein the start-up circuit comprises:

a voltage divider connected between the supply voltage (Vdd) and the common ground (Vss);

a comparator having a non-inverted input connected to the voltage divider, an inverted input connected to the source of the driver stage transistor and receiving the output voltage (Vout), and an output;

a first inverter having an input connected to the output of the comparator;

a second inverter having an input connected to the output of the first inverter;

a first start-up circuit transistor having a drain connected to the supply voltage (Vdd), a source connected to the output of the operational amplifier and receiving the drive voltage (Vdriver), and a gate connected to an output of the second inverter, and wherein a bulk connected to the common ground (Vss);

a second start-up circuit transistor having a drain connected to the inverted input of the operational amplifier, and a source connected to the common ground (Vss);

a third start-up circuit transistor having a drain connected to the non-inverted input of the operational amplifier, a source connected to the common ground (Vss), and a gate connected to the gate of the second start-up circuit transistor, and wherein the gates of the second and third start-up circuit transistors are connected to the output of the second inverter;

a fourth start-up circuit transistor having source connected to the inverted input of the comparator and receiving the output voltage (Vout), a drain connected to the operating voltage (Vbgr), and a gate connected to the gates of the second and third start-up circuit transistors and the output of the second inverter; and a capacitor connected between the output of the comparator and the supply voltage (Vdd).

9. The system of claim 8, wherein the voltage divider comprises:

a first voltage divider transistor;

a second voltage divider transistor; and a third voltage divider transistor, wherein the first voltage divider transistor has a drain and a gate connected together and to the supply voltage (Vdd);

the second voltage divider transistor has a drain and a gate connected to a source of the first voltage divider transistor; and the third voltage divider transistor has a drain and a gate connected together and to the source of the second voltage divider transistor, and a source connected to the common ground (Vss).

10. The system of claim 9, wherein the non-inverted input of the comparator is connected to the drain of the third voltage divider transistor and a fraction of the supply voltage (Vdd) is provided to the non-inverted input of the comparator.

11. The system of claim 10, wherein the fraction of the supply voltage (Vdd) derived at the non-inverted input of the comparator is Vdd/3.

* * * * *